United States Patent [19]

Kohno et al.

[11] Patent Number: 4,965,159

[45] Date of Patent: Oct. 23, 1990

[54] CARRIER FOR DEVELOPING ELECTROSTATIC IMAGE, AND DEVELOPER FOR DEVELOPING ELECTROSTATIC LATENT IMAGE CONTAINING SAME CARRIER

[75] Inventors: Shigenori Kohno, Tachikawa; Kenji Tsujita, Fujino, both of Japan

[73] Assignee: Konica Corporation, Tokyo, Japan

[21] Appl. No.: 485,844

[22] Filed: Feb. 20, 1990

Related U.S. Application Data

[63] Continuation of Ser. No. 224,098, Jul. 26, 1988, abandoned.

[30] Foreign Application Priority Data

Jul. 29, 1987 [JP] Japan ..... 62-189832
Jul. 29, 1987 [JP] Japan ..... 62-189834

[51] Int. Cl.[5] ..... G03G 9/10

[52] U.S. Cl. ..... 430/108; 430/138; 428/402.24; 428/404; 428/406; 428/407

[58] Field of Search ..... 430/108, 138; 428/404, 428/406, 407, 402.24

[56] References Cited

U.S. PATENT DOCUMENTS 4,614,700 9/1986 Yamamoto et al. ..... 430/108 X

FOREIGN PATENT DOCUMENTS 61-110160 5/1986 Japan ..... 430/108
61-120169 6/1986 Japan ..... 430/108
62-39879 2/1987 Japan ..... 430/108
62-39880 2/1987 Japan ..... 430/108
63-11958 1/1988 Japan ..... 430/108

*Primary Examiner*—Roland E. Martin
*Attorney, Agent, or Firm*—Finnegan, Henderson, Farabow, Garrett and Dunner

[57] ABSTRACT

A carrier for use in a developer for electro-photography, which comprises a core material and provided thereon in order, an intermediate resin layer and a layer for controlling triboelectric chargeability, said resin containing as a repeating unit a fluorinated alkylmethakrylarte unit, and a developer for electrophotography using the carrier and a positively chargeable toner is disclosed.

15 Claims, No Drawings

CARRIER FOR DEVELOPING ELECTROSTATIC IMAGE, AND DEVELOPER FOR DEVELOPING ELECTROSTATIC LATENT IMAGE CONTAINING SAME CARRIER this application is a continuation of patent application Ser. No. 07/224,098, filed July 26, 1988, now abandoned.

FIELD OF THE INVENTION

The present invention relates to a developer and a carrier for developing an electrostatic latent image, both used for converting, by virtue of positively charged toner powder, a negatively charged electrostatic latent image into a positive image. More specifically, the invention relates to a carrier incorporated into a developer that is used, together with positively charged toner particles contained therein, to develop a negatively charged electrostatic latent image, wherein the carrier is capable of endowing toner particles with positive charge by friction with toner particles.

The present invention also relates to a developer for converting, by using positively charged toner powder, a negatively charged electrostatic latent image into a toner image. More specifically, the invention relates to a developer for converting a negatively charged electrostatic latent image into a toner image, wherein the developer is a two component developer comprising a toner capable of being positively charged and carrier being capable of endowing toner particles with a positive charge.

BACKGROUND OF THE INVENTION

A two component type developer for visualizing a negatively charged electrostatic latent image in electrophotography comprises a toner that is capable of being positively charged, and a positive-charge endowing i.e., negatively chargeable carrier.

Hitherto, an example of such a carrier is a single layer coated carrier wherein a carrier core material is coated with an acrylic resin.

The acrylic resin adheres well to the core material, and also exhibits good coating properties; however, the surface of carrier particles is readily contaminated with toner particles (that means poor resistance against contamination of the carrier surface). Furthermore, acrylic resin exhibits large negative-charge endowing ability.

In view of these drawbacks, use of a fluorinated polymer has been studied, and such a polymer is deemed a coating material exhibiting good resistance against surface-contamination and of which positive-charge endowing property relative to toner particles readily maintained.

Though having a strong positive-charge endowing property, the fluorinated polymer has disadvantages; for example, it poorly adheres to a core material; and pin holes are likely to be formed due to its poor coating property. Additionally, when using such a fluorine polymer coating material, flakes of the resin form lamination on the core material and the mechanical strength of individual particles is insufficient; flake-shaped resin peels off in the course of repeated use of a developer. In summary, the carrier coated with a fluorine polymer has been found unsatisfactory in long-range stability of a positive-charge endowing property.

Generally, a single layer-coated carrier should have a thicker coating layer to have a large charge capacity.

However, a thicker coating layer incurs various problems such as: a solvent used in forming a coating layer remains in the resultant coating layer; the fluidity of a developer is deteriorated; a level of charge potential does not readily rise.

Since a fluororesin excels in surface-fouling resistance, and is capable of endowing carrier particles with good powder properties, there have been studies as to the use of multi-layer coated carrier particles, with each particle comprising a plurality of coating layers.

Japanese Patent Publication Open to Public Inspection (hereinafter referred to as Japanese Patent 0.P.I. Publication) No. 110160/1987 discloses such a multi-layer coated carrier principally characterized in that individual particles comprise a core material provided thereon sequentially a triboelectricity controlling layer and a layer contains fluoroalkyl acrylate polymer or fluoroalkyl methacrylate polymer, with the respective monomeric units account for not more than 50 wt% of the surface layer material, wherein the surface layer is capable of being electrified depending on the polarity of the triboelectricity controlling layer.

In other words, this multi-layer coated carrier is a carrier for developing electrostatic latent image, and whose individual particles comprise a core material provided thereon sequentially a triboelectricity controlling layer (intermediate layer) and a self-cleaning type surface layer (outermost layer), and the content of fluoroalkyl (meth)acrylate polymer in the peeling-type surface layer (outermost layer) is not more than 50 wt%, whereby regardless of the characteristics of the resin of the peeling-type surface layer (outermost layer), it is possible to make the characteristics of the resin of the triboelectricity controlling layer (intermediate layer) prevail over the former, so as to vary the charge-endowing property of the carrier. Accordingly, the charge-endowing property of the carrier relative to the toner particles is always dependent upon the resin used in the triboelectricity controlling layer (intermediate layer).

If a positive-charge endowing resin is used as the resin of the triboelectricity controlling layer (intermediate layer), the charge-endowing property of the resin of the triboelectricity controlling layer (intermediate layer) becomes prevailing in the course of time. Correspondingly, the charge capacity of a developer in the initial stage of usage can be significantly different from that resulting from a developer undergone repeated use. Such a carrier has another problem; regardless of when a developer is used, whether at the initial stage of usage or after repeated use, the charge property on the carrier surface tends to be unstable, degrading the quality of developed images.

Japanese Patent 0.P.I. Publication No. 39880/1987 discloses a carrier for incorporation into a two-component developer, wherein individual carrier particles comprise a core material coated with an upper triboelectricity controlling layer and a lower triboelectricity controlling layer. This patent further discloses incorporation of a fluoroalkyl acrylate polymer in the upper triboelectricity controlling layer.

With this carrier, however, the charge-endowing property of the upper triboelectricity controlling layer is allowed to be prevailing at a comparatively early stage of service life, while the charge-endowing property of the lower triboelectricity controlling layer is allowed to develop far later (i.e. in the course of repeated use), in order to prevent excess accumulation of a charge potential caused by agitation of carrier. Therefore, it is impossible to provide a carrier that always exhibits a stable positive-charge endowing property. This type of carrier is disadvantageous in that under the conditions of a high temperature and high humidity, and depending upon the content ratio of the fluoroalkyl acrylate in the upper triboelectricity controlling layer, the property of resin in the lower triboelectricity controlling layer will prevailing on the surface of individual carrier particles, thus such a carrier does not serve as a carrier of stable positive-charge endowing property.

In summary, the charge-endowing property of the carrier described in the above-mentioned patent publication varies depending on a type of the resin of the triboelectricity controlling layer (intermediate layer), and is unsatisfactory as a carrier for use with the toner particles that incorporate, as a binder, a resin exhibiting a strong negative-charge endowing property, e.g. a polyester resin.

SUMMARY OF THE INVENTION

An object of the present invention is to provide a carrier that is capable of endowing toner particles with positive charge, wherein the surface of carrier particles constantly exhibits a stable charge-endowing property.

Another object of the invention is to provide a carrier that satisfies various characteristics required of a carrier, for example, powder properties, and this carrier is always capable of endowing toner particles with a positive charge, wherein the positive-charge endowing property remains stable for a long period.

Another object of the invention is to provide the similar carrier, wherein even under the conditions of a high temperature and high humidity, various properties required of a carrier is always stable, and, at the same time, the positive-charge endowing property of the carrier relative to toner particles is always stable.

Another object of the invention is to provide a developer for developing an electrostatic latent image, and the developer contains toner particles that are capable of being endowed with a strong positive charge, and a multi-layer coated carrier capable of properly electrifying the toner particles, wherein the developer for developing an electrostatic latent image exhibits even at the initial stage of usage a good developing property, and is capable of maintaining the property for quite a long period.

Still another object of the invention is to provide a developer for developing an electrostatic latent image used in an electrophotographic process or the like, and is always capable of exhibiting with a strong positive charge, and a multi-layer coated carrier capable of properly electrifying the toner particles, wherein the developer for developing an electrostatic latent image exhibits stable properties even under the conditions of a high temperature and high humidity.

The invention relates to a carrier for developing an electrostatic latent image, incorporated into a developer that develops a negatively charged electrostatic latent image, by means of positively charged toner particles, wherein the individual carrier particles comprise a core material coated sequentially with a styrene resin layer and a triboelectricity controlling layer.

The invention also relates to a developer for developing a negatively charged electrostatic latent image with positively charged toner particles, where the developer comprises toner particles as well as carrier that is capable of endowing the toner particles with a positive charge, and the developer is characterized in that the individual carrier particles comprise a core material coated with an intermediate layer, and with a triboelectricity controlling layer containing fluoroalkyl (meth)acrylate polymer, and in that the triboelectricity controlling layer contains not less than 50 wt% repeating structural units of fluoroalkyl (meth)acrylate, and in that the toner particles contain a polyester resin.

The carrier of the invention for developing an electrostatic latent image is a carrier incorporated into a developer that is used on an electrophotographic copying apparatus or the like and develops a negatively charged electrostatic latent image by using positively charged toner particles, therefore, the carrier of the invention is a positive-charge endowing carrier.

The developer of the invention for developing an electrostatic latent image, that is formed with a negative charge on an electrophotographic copying apparatus or the like, is a developer that develops a negatively charged electrostatic latent image by using positively charged toner particles, therefore, the developer of the invention cannot be used to developed a positively charged electrostatic latent image.

The examples of a core material useful in preparing cores of the carrier of the invention for developing an electrostatic latent image are materials used as a core material of an ordinary coated carrier and include inorganic powder such as glass beads; metal powder such as aluminum powder, iron powder, and nickel powder; metal oxide materials such as iron oxide, ferrite, and magnetite; organic metal powder such as carbonium iron powder.

Cores for the carrier have particle sizes that make, to be within a range of 10 to 500 $\mu$m, the sizes of the carrier particles prepared by forming an intermediate coating layer and a triboelectricity controlling layer. There is no specific limitations on the configurations of cores as far as they are conventional ones. However, from the viewpoint of the powder properties of the obtained carrier particles, the preferred configuration is either spherical or oval one.

The examples of a resin for forming the intermediate layer include styrene resins (e.g. styrene homopolymer, and styrene-alkyl (meth)acrylate copolymer); poly(-meth)acrylic ester resins (e.g. methyl polymethacrylate); polyolefine resins (e.g. polyethylene resin, LLDPE, and polybutadiene resin); polyurethane resins (e.g. polyurethane resin, and polyester/polyurethane resin); nitrogen-containing vinyl copolymers (e.g. polyvinylpolydiene); polyester resins (e.g. polymer derived from both a diol such as ethylene glycol and an organic acid such as a divalent carboxylic acid typified by maleic acid); polyamide resins (e.g. 6-nylon, and 6,6-nylon); polycarbonates (e.g. polyethylene phthalate); cellulose derivatives (e.g. nitrocellulose, and alkylcellulose); and silicon resins.

According to the invention, the particularly preferred resin for forming an intermediate layer of the carrier is a styrene resin.

The examples of a styrene resin for forming the above-mentioned styrene based resin layer include homopolymers of such styrene monomers as alkyl styrenes, for example, styrene, methylstyrene, dimethylstyrene, trimethylstyrene, ethylstyrene, diethylstyrene, triethylstyrene, propylstyrene, butylstyrene, hexylstyrene, heptylstyrene, and octylstyrene, and styrene halides, for example, fluorostyrene, chlorostyrene, bromostyrene, dibromostyrene, and iodostyrene, and nitrostyrene, acetylstyrene, and methoxystyrene; copolymers of any of these styrene monomers; copolymers between any of these styrene monomers and alkyl (meth)acrylate.

Among these styrene resins, the preferred resins are styrene homopolymers, and styrene-alkyl (meth)acrylate copolymers, in particular, styrene-alkyl (meth)acrylate copolymers.

Styrene resins adhere well to a core material and to a fluoroalkyl (meth)acrylate polymer. Accordingly, a styrene resin is not only capable of improving mechanical strength of obtained carrier particles but, compared with other resins, capable of endowing for an extended period the particles with electrical charge. Additionally, a styrene resin used for this purpose virtually prevents, even a developer is preserved or used for a long period under the conditions of a high temperature and high humidity (e.g. temperature, 30° C; humidity, 80%), the fluctuation in a charge-endowing property of the carrier, and, at the same time, such a carrier exhibits only minimum degradation in powder properties.

When using a styrene-alkyl (meth)acrylate copolymer, a useful alkyl (meth)acrylate is usually methyl methacrylate (MMA). In this case, the preferred molar ratio of the repeating styrene units in the copolymer to the repeating methyl methacrylate units therein is within a range of 50:50 to 95:5 (more specifically, 55:45 to 90:10). Using a copolymer that satisfies the above criteria not only further improves the powder properties of the carrier but improves the charge-endowing property at the initial stage of usage, and maintains the property for a long period.

The number average molecular weight of the above-mentioned copolymer is usually within a range of 50000 to 200000; the Mw/Mn ratio is usually within a range of 1.0 to 5.0, preferably, within a range of 1.5 to 2.5.

Additionally, such a copolymer can contain another type of repeating structural units at a ratio not jeopardizing the properties of the carrier of the invention.

The thickness of the intermediate layer can be arbitrarily determined depending on the particle sizes of cores and the thickness of the triboelectricity controlling layer. The criterion for the intermediate layer thickness is usually that (weight of resin for forming intermediate layer)/(weight of cores) is 0.2 to 5.0, preferably, 0.5 to 2.5.

The thickness of the intermediate layer that is formed, in conformity to the above criterion, on cores is usually not less than 0.05 μm (preferably, 0.1 to 2.0 μm).

The triboelectricity controlling layer contains a fluoroalkyl (meth)acrylate polymer.

It is important that the content of repeating fluoroalkyl (meth)acrylate unit in this layer is not less than 50 wt%, in particular, not less than 55 wt%.

If the content of repeating fluoroalkyl (meth)acrylate units is not more than 50 wt%, the charge-endowing property of the carrier will fluctuate, and the carrier may not always positively charge the toner particles; furthermore, the charge potential of a developer at the initial stage of a copying operation may be excessively low ("poor starting"). Additionally, in the course of repeated use, the charge-endowing property of the styrene resin layer sometimes gradually becomes prevailing in the course of repeated use, and, it may be impossible to stably maintain the charge-endowing property of the carrier. In particular, under the conditions of a high temperature and high humidity, the charge-endowing property may fluctuate more greatly; additionally, a developer powder more frequently flies around in a copying apparatus.

Making the content of repeating fluoroalkyl (meth)acrylate units to be not less than 50 wt% usually sets the initial charge potential of a developer within a range of 10 to 40 μc/g, and, at the same time, the charge potential less prone to decrease in the course of a copying operation. Accordingly, vivid positive images are continuously available from the initial stage of using a developer, and, additionally, the so-called "fog" does not virtually occur. Furthermore, this arrangement further improves various properties, including the mechanical strength, of the carrier, thus improving the durability of the developer that contains the carrier of the invention.

Increasing the content of a fluoroalkyl (meth)acrylate polymer in this layer to not less than 70 wt% (more favorably, not less than 75 wt%) will still further improve various properties, including the mechanical strength, of the carrier. If the content does not reach this level, the characteristics of a fluoroalkyl meth(acrylate) polymer may fail to be fully present.

As the repeating fluoroalkyl (meth)acrylate units within the fluoroalkyl (meth)acrylate polymer that constitutes the triboelectricity controlling coating layer of the carrier of the invention, the repeating structural units represented by the following formula [I] are available.

$$\left(CH_2-\underset{\underset{O=C-R^2}{|}}{CR^1}\right) \quad [I]$$

In formula [I], $R^1$ represents a hydrogen atom or methyl group; $R^2$ is a residue group formed from an alcohol compound containing an alkyl group whose at least one hydrogen atom has been substituted with a fluorine atom, wherein a hydrogen atom on the hydroxyl of the same compound has been split off.

The preferred examples of the repeating structural units represented by the above formula [I] are as follows. The repeating structural units defined by either formula (a) or (b) can be present either singly or in combination.

$$\left(CH_2-\underset{\underset{O=CO(CH_2)_nC_mF_{2m+1}}{|}}{CR^1}\right) \quad (a)$$

$$\left(CH_2-\underset{\underset{O=CO(CH_2)_p(CF_2)_qH}{|}}{CR^1}\right) \quad (b)$$

In formula (a) and (be), $R^1$ represents a hydrogen atom or methyl group; n and p independently represents an integer of 1 to 8; m and q independently represents an integer of 1 to 19.

The examples of alcohol compounds capable of forming a residue group represented by $R^2$ in formula [I] are as follows:

Perfluoro-alcohols (e.g. perfluoromethanol, perfluoroethanol, perfluoropropanol, perfluorobutanol, perfluoropentanol, perfluorohexanol, perfluoroheptanol, perfluorooctanol, perfluorodecanol, and perfluorostearyl alcohol);

1,1-dihydroperfluoro-alcohols or trihydroperfluoroalcohols represented by the following formula:

$$CF_2X(CF_2)nCH_2OH$$

(wherein n is usually an integer of 1 to 16; X represents a hydrogen atom or fluorine atom; the typical examples of such alcohols include 1,1-dihydroperfluoroethanol, 1,1-dihydroperfluoropropanol, 1,1-dihydroperfluorohexanol, 1,1-dihydroperfluorooctyl alcohol, 1,1-dihydroperfluooolauryl alcohol, 1,1-dihydrostearyl alcohol, 1,1,2-trifluoroethanol, 1,1,3-trifluoropropanol, 1,1,4-trifluorobutanol, 1,1,5-trifluoropentanol, and 1,1,18-trifluorostearyl alcohol);

Tetrahydroperfluoro-alcohols represented by the following formula:

$$CF_3(CF_2)n(CH_2CH_2)(CF_2)mOH$$

wherein n is usually 0 or an integer of 1 to 15; m is 0 or 1; the typical examples of such alcohols include 1,1,2,2-tetrahydroperfluoroethanol, 1,1,2,2-tetrahydroperfluoropropanol, 1,1,2,2-tetrahydroperfluorohexanol, 1,1,2,2-tetrahydroperfluorooctyl alcohol, 1,1,2,2-tetrahydro-perfluorolauryl alcohol, 1,1,2,2-tetrahydrostearyl alcohol, and 2,2,3,3-trifluoropropanol;

Other luoro-alcohols (e.g. 2,2,3,3,4,4-tetrafluoropropanol, 1,1,ω-trihydroperfluorohexanol, 1,1,ω-trihydroperfluorooctanol, 1,1,1,3,3,3-hexafluoro-2-propanol);

Acetyl alcohols (e.g. 3-perfluorononyl-2-acetylpropanol, and 3-perfluorolauryl-2-acetylpropanol);

N-fluoroalkylsulfonyl-N-alkylamino alcohols (e.g. N-perfluorohexylsulfonyl-N-methylaminoethanol, N-perfluoro-hexylsulfonyl-N-butylaminoethanol, N-perfluorooctyl-sulfonyl-N-methylaminoethanol, N-perfluorooctylsulfonyl-N-ethylaminoethanol, N-perfluorooctylsulfonyl-N-butylaminoethanol, N-perfluorodecylsulfonyl-N-methylaminoethanol, N-perfluorodecylsulfonyl-N-ethylaminoethanol, N-perfluorodecylsulfonyl-N-butylaminoethanol, N-perfluorolaurylsulfonyl-N-methylaminoethanol, N-perfluorolaurylsulfonyl-N-ethylaminoethanol, and N-perfluorolaurylsulfonyl-N-butylaminoethanol).

According to the invention, the preferred repeating (meth)acrylate units having a fluorine-substituted alkyl group are those defined below.

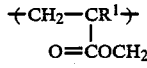

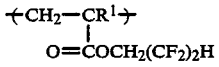

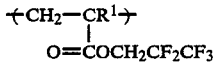

In these formulas, $R^1$ represents a hydrogen atom or methyl group.

The fluoroalkyl (meth)acrylate polymer can be either a polymer comprising any of the above-mentioned types of repeating structural units alone or a polymer also containing another type of repeating structural units. If the polymer contains another type of repeating structural units, the similar polymer preferably contains not less than 50 mol% (in particular, not less than 55 mol%) of repeating structural units that have within polymeric structure the above-defined fluorine substituted alkyl group.

If the content of the above-mentioned repeating structural units in a polymer does not reach 50 mol%, and when the carrier is subjected to extreme ambient conditions, the charge-endowing property of the carrier may deteriorate depending on a nature of another type of repeating structural units or by the influence of a styrene resin layer.

According to the invention, the examples of another type of repeating structural units that, together with the repeating structural units having a fluorine-substituted alkyl group, are capable forming a fluoroalkyl (meth)acrylate polymer are as follows: repeating structural units derived from aliphatic olefins (examples of aliphatic olefins; ethylene, propylene, and butene-1); repeating structural units derived from halogenoaliphatic olefins (examples of halogenoaliphatic olefins; vinyl chloride, vinyl bromide, vinyl iodide, 1,2-dichloroethylene, 1,2-dibromoethylene, 1,2-diiodoethylene, isopropenyl chloride, allyl chloride, allyl bromide, vinyl fluoride, and vinylidene fluoride); repeating structural units derived from conjugated diene-based aliphatic diolefins (examples of conjugated diene-based aliphatic diolefins; 1,3-butadiene, 1,3-pentadiene, 2-methyl-1,3-butadiene, 2,3-dimethyl-1, 3-butadiene, 2,4-hexadiene, and 3-methyl-2,4-hexadiene); repeating structural units derived from aromatic vinyl compounds (examples of aromatic vinyl compound; styrene, and methylstyrene); repeating structural units derived from nitrogen-containing vinyl compounds (examples of nitrogen-containing vinyl compounds; 2-vinylpyridine, 4-vinylpyridine, 2-vinyl-6-methylpyridine, 2-vinyl-5-methylpyridine, 4-butenylpyridine, 4-pentylpyridine, N-vinylpyridine, 4-vinylhydropiperidine, 4-vinyldihydropiperidine, N-vinyldihydropiperidine, N-vinylpryrrole, 2-vinylpyrroline, N-vinylpyrrolidine, 2-vinylpyrrolidine, N-vinyl-2-pyrrolidone, and N-vinylcarbazole). These units may be used singly or in combination of more than two.

Among these repeating structural units, those especially preferable are styrene, methylstyrene, and methyl (meth)acrylate.

Even if solubility is high, a polymer or copolymer selected from those listed above, when its molecular weight excessively great, results in a highly viscous coating solution, and readily causes pin holes in the course of layer forming. According to the invention, to ensure the properties including layer forming properties to be satisfactory, the polymer or copolymer to be used exhibits intrinsic viscosity, measured in methylethylketone (35° C.), of 0.1 to 5.0 dl/g, or, preferably, 0.4 to 0.8 dl/g.

According to the invention, the triboelectricity controlling layer can be formed with a fluoroalkyl (meth)acrylate polymer alone, or with a fluoroalkyl (meth)acrylate polymer and another type of polymer.

The examples of such another type of polymer include polymethylmethacrylate, polyethylmethacrylate, polymethylacrylate, and polyethylacrylate. The preferred one is polymethylmethacrylate.

The thickness of the triboelectricity controlling layer can be arbitrarily determined depending on the particle sizes of cores and the thickness of the styrene resin layer. The criterion for the thickness is usually that (weight of resin for forming styrene layer)/(weight of cores) is 0.2 to 5.0, preferably, 0.54 to 2.5.

The thickness of the triboelectricity controlling layer that is formed using a resin, in conformity to the above criterion, is usually not less than 0.05 μm (preferably, 0.1 to 2.0 μm).

With the above criterion being satisfied, the initial charge potential of the developer for developing an electrostatic latent image is significantly improved; and the charge potential is not prone to fluctuate in the elapse of time, and, additionally, above all, the powder properties under the conditions of a high temperature and high humidity tend to be better.

The above-mentioned carrier is prepared in a conventional coated carrier preparation process, wherein the intermediate layer is formed around core materials, and then, the triboelectricity controlling layer is formed on the intermediate layer.

The total thickness of the intermediate and triboelectricity controlling layers of the so-prepared carrier is usually not more than 20 μm (preferably, not more than 5 μm).

The carrier of the invention prepared in the above-mentioned process or the like can be used as a carrier, as blended with positive charge type toner particles, for developing a negatively charged electrostatic latent image. As the toner particles, those incorporating a polyester resin as a binder are advantageous.

The polyester resin preferably used as a binder for preparing the toner particles of the present invention is obtained by copolymerization between alcohol and carboxylic acid. The examples of alcohol useful for this purpose include diols such as ethylene glycol, triethylene glycol, 1,2-propylene glycol, 1,3-propylene glycol, 1,4-butanediol, neopentyl glycol, 1,4-butenediol, and polyoxypropane (2,2)-2,2-bis(4-hydroxyphenyl)propane; etherified bisphenols A's such as 1,4-bis(hydroxymethyl)cyclohexane, bisphenol A, hydrogenated bisphenol A, polyoxyethylene bisphenol A, and polyoxypropylene bisphenol A; and other alcohol monomers.

In addition to the above dihydric alcohols, as for useful polyhydric alcohols, polyhydric alcohols which are multifunctional monomers greater than trifunctional monomers are used independently or in conjunction with any of the above dihydric alcohols.

The examples of the polyhydric alcohols, which are the above described multifunctional monomers and have at least 3 hydroxy groups, include sorbitol, 1,2,3,6-hexanetetrol, 1,1-sorbitan, pentaerythritol, dipentaerythritol, tripentaerythritol, saccharose, 1,2,4-butanetriol, 1,2,5-pentatriol, glycerol, 2-methylpropanetriol, 2-methyl-1,2,4-butanetriol, trimethylolethane, trimethylolepropane, and 1,3,5-trihydroxymethylbenzene.

Among the above-mentioned polyhydric alcohols, the dihydric alcohols are preferably used in the present invention.

The examples of useful carboxylic acids include maleic acid, fumaric acid, mesaconic acid, citraconic acid, itaconic acid, glutaconic acid, phthalic acid, isophthalic acid, terephthalic acid, cyclohexanedicarboxylic acid, succinic acid, adipic acid, sebacic acid, and malonic acid; and the anhydrides of these acids.

In addition to the above carboxylic acids, the examples of useful multifunctional carboxylic acids include polycarboxylic acids which are multifunctional monomers greater than trifunctional monomers.

The examples of useful polycarboxylic acid monomers containing at least three carboxylic acid groups include 1,2,4-benzenetricarboxylic acid, 1,2,5-benzenetricarboxylic acid, 1,2,4-cyclohexanetricaboxylic acid, 2,5,7-naphthalenetricaboxylic acid, 1,2,5-cyclohexanetricaboxylic acid, 1,2,4-butanetricaboxylic acid, 1,2,5-hexanetricaboxylic acid, 1,3-dicarboxy-2-methyl-2-methylenecarboxypropane, tetra(methylenecarboxy)methane, 1,2,7,8-octanetetracarboxylic acid, and empoltrimeric acid; and the anhydrides of these acids.

Among the above-mentioned caboxylic acids, the aromatic dicaboxylic acids are preferably used in the present invention. Among the aromatic dicaboxylic acids, one or more than two dicaboxylic acids selected from phthalic acid, isophthalic acid and terephthalic acid are particularly preferably used.

The polyester polymer made from the above-mentioned polyhydric alcohol and polycarboxylic acid can be prepared by reacting a polyhydric alcohol compound and an organic caboxylic acid compound according to a conventional process so that the hydroxyl group on a polyhydric alcohol can be combined with the carboxy group on a carboxylic acid.

The binder for the toner particles may consist of the above polyester polymer alone or may contain other resins as far as the characteristic of the polyester polymer is not hindered. In the latter case, the content ratio of the polyester polymer is commonly not less than 50 wt%, preferably, not less than than 70 wt%.

The toner particles used in the present invention are prepared based on known processes, for example, the obtained polyester polymer and a coloring agent are blended together using a ball mill or the like; the resultant mixture is further kneaded, pulverized and classified. Additionally, additives conventionally used in preparing toner particles, such as and anti-offset agent and a charge control agent may be employed in accordance with a specific requirement.

The toner particles may be obtained by other known methods such as the spray dry process, interfacial polymerization, suspension polymerization, solution polymerization.

The particle sizes of the toner particles prepared by the above processes are usually within a range of 1 to 100 μm, preferably, within a range of 5 to 30 μm.

The typical examples of the coloring agents contained in the toner particles include Carbon Black used as a black pigment, as well as color pigments such as Nigrosine, Aniline Blue, Chalcoil Blue, Chrome Yellow, Ultramarine Blue, Methylene Blue, Rose Bengal and Phthalocyanine Blue and the like. These examples may be used either singly or in combination of more than two.

The developer of the invention for developing an electrostatic latent image essentially contains both the above-mentioned toner particles and the above-mentioned carrier. Usually, the toner particles/carrier particles ratio in the developer of the invention for developing an electrostatic latent image is within a range of 1:99 to 10:90, preferably, 2:98 to 8:92.

EFFECTS OF THE INVENTION

The developer of the invention for developing an electrostatic latent image comprises a carrier whose individual particles comprising a core disposed thereon a dual coating layer composed of an intermediate layer, as well as a triboelectricity controlling layer that contains a fluoroalkyl (meth)acrylate polymer, wherein the fluoroalkyl (meth)acrylate polymer in the triboelectricity controlling layer is composes of a specific limited number of repeating structural units, and the developer of the invention further comprises toner particles which individual contains a polyester resin as a binder. Such a carrier is advantageous in that: (1) The coating layer on the individual carrier particles is significantly thinner than that of a conventional single layer-coated carrier particles. (2) Even with a thin coating layer, the rise in initial charge potential is as smooth as in a carrier of a thick coating layer. (3) Such a charge-endowing property of the similar carrier is maintained for a long period. (4) Even under the environments of a high temperature and high humidity, the excellent charge endowing property of the carrier seldom deteriorates.

The above-mentioned carrier and the above-mentioned toner particles, when combinedly used, provides an appropriate level of positive potential to the toner particles in the developer of the invention for developing an electrostatic latent image, even the initial stage for using the developer, wherein the positive potential is less prone to decrease even in the course of repeated use. Accordingly, regardless conditions under which it is used, i.e. a normal condition or the severe conditions of a high temperature and high humidity, the developer of the invention is capable of developing an electrostatic latent image into a vivid positive image, for a long service life, since the charge potential of toner is less prone to change in the course of time, as well as the powder properties of developer is less prone to change in the course of time.

Additionally, since virtually all the toner particles constantly have an appropriate level of triboelectricity, non-charged toner particles or the like seldom erroneously fly around in a copying apparatus, whereby either the fog induced by errorneously flying toner particles or the density difference between the leading edge and trailing edge of a positive image seldom occurs.

The examples of the present invention and comparative examples are hereunder described.

EXAMPLES 1 through 7

Preparation of Carriers

Into 400 ml mixture solvent of toluene and methanol (volume ratio=9:1) was dissolved 20 g methyl methacrylate/styrene copolymer (copolymer molar ratio=4:6, Mw=134000, Mw/Mn=1.9) to prepare a coating solution for forming a styrene resin layer.

The coating solution was applied onto 2 kg ferrite core particles (F-150, manufactured by Nippon Teppun Co., Ltd.; average particle size, 80 μm) using a fluidized bed/tumbling coating machine (Okada Seiko Co., Ltd.; spiller coating system) to form a styrene resin layer on the surface of individual core particles.

Then, 40 g of a fluoroalkyl methacrylate copolymer, comprising each one type of the repeating structural units correspondingly represented by one of the following formulas 1 through 7, was dissolved in 800 ml toluene to prepare each of coating solutions (a) through (g) for forming a triboelectricity controlling layer.

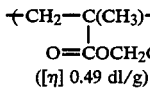

(1)

([η] 0.49 dl/g)

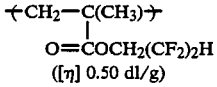

(2)

([η] 0.50 dl/g)

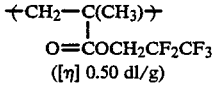

(3)

([η] 0.50 dl/g)

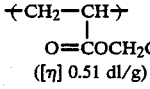

(4)

([η] 0.51 dl/g)

-continued

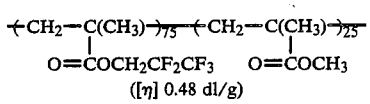

(5)

([η] 0.48 dl/g)

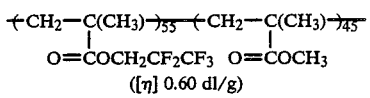

(6)

([η] 0.60 dl/g)

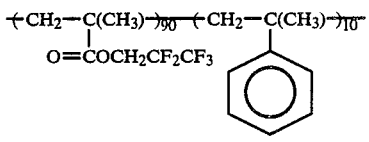

(7)

([η] 0.48 dl/g)

Each of the so-obtained coating solutions (a) through (g) was applied onto the above-mentioned styrene resin layer of the individual core particles by means of the fluidized bed/tumbling coating machine to form a triboelectricity controlling layer, whereby each of positive-charge endowing carriers for developing an electrostatic latent image were prepared.

Preparation of Toner 100 parts by weight styrene/methyl methacrylate/n-butyl methacrylate copolymer obtained by reacting together styrene, methyl methacrylate and n-butyl methacrylate at a molar ratio of 50:20:30, 10 parts by weight Carbon Black (Regal 660R manufactured by Cabot Co., Ltd.) and 3 parts by weight low-molecular polypropylene (Viscol 660P manufactured by Sanyo Chemical Industry Co., Ltd.) were mixed by means of a ball mill and further treated in the processes involving kneading, pulverization and classification. Then, to the resultant particles were added 0.4 wt% fine hydrophobic silica particles "Aerosil R-812" and 0.2 parts by weight zinc stearate to prepare a positive-charge type toner.

The average particle size of the so-obtained toner was 11 μm.

Preparation of Developers

The above-mentioned carrier and toner were blended together to prepare each of the developers of the invention whose contents of the toner were respectively 4 wt%.

Evaluation

Continuous copying operation was performed with each of the obtained developers, by employing a modified electrophotographic copier (U-Bix Model 1550 manufactured by Konica Corporation), which incorporated a negative charge type organic dual-layer photoreceptor containing an anthoanthrone dye as a carrier generating material as well as a carbazole derivative as a carrier transporting material.

With regards to each of the developers, Table 1 lists the data of the initial charge potential, initial image, final image, difference in density between the leading edge and trailing edge of a duplicate, maximum number of copies produced by continuous copying operation (durability), as well as the state of developer that erroneously flew around in the copier.

Further, continuous copying operation was performed by using the above copier under the conditions of a temperature of 30° C and a humidity of 80%.

With regards to each of the developers, Table 2 lists the data of the initial charge potential, initial image, final image, difference in density between the leading edge and trailing edge of a duplicate, a number of duplicates produced by the continuous copying operation, as well as the state of developer that erroneously flew around in the copier.

EXAMPLE 8

Instead of a coating solution for forming a triboelectricity controlling layer that was prepared by using the fluoroalkyl methacrylate copolymer of Example 3 [formula (3) defined previously], a coating solution for forming a triboelectricity controlling layer was prepared by dissolving 32 g fluoroalkyl methacrylate copolymer [formula (3) defined previously]and 8 g methyl polymethacrylate [BR-83 manufactured by Mitsubishi Chemical Industries/ Ltd.] into 800 ml mixture solvent of acetone and toluene (volume ratio =9 : 1). Apart from that, the same steps as in Example 3 were exercised to prepare a positive-charge endowing carrier for developing an electrostatic latent image as well as a toner, thereby a developer was prepared.

The obtained developer was evaluated in a manner identical with that of Example 1. The results are listed in Tables 1 and 2.

COMPARATIVE EXAMPLE 1

A fluoroalkyl methacrylate copolymer composed of repeating structural units defined below ([η] 0.60 dl/g) was used instead of the fluoroalkyl methacrylate copolymer used in Example 3. Other than this arrangement, a carrier was prepared in a manner identical with that of Example 1, and then toner was prepared in a manner identical with that of Example 1.

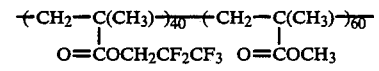

The positive-charge endowing property of the so-formed intermediate coating layer became prevailing, thereby the carrier exhibited a charge-endowing property. However, the resultant initial charge potential of the obtained toner was low.

The properties of the developer were evaluated as in Example 1. The results are listed in Tables 1 and 2.

COMPARATIVE EXAMPLE 2

A carrier was prepared in a manner identical with that of Example 3 except that a coating solution used was a coating solution for forming a triboelectricity controlling layer prepared by dissolving both 16 g fluoroalkyl methacrylate used in Example 3 and 24 g methyl methacrylate used in Example 1 in 800 ml acetone/toluene mixture solvent (mixture ratio by volume =9 : 1), thereby a developer was prepared in a manner identical with that of Example 3.

The positive-charge endowing property of the so-formed styrene resin layer became prevailing, thereby the carrier exhibited a charge-endowing property. However, the resultant initial charge potential of the obtained developer was low, and the durability of the developer was poor.

The properties of the developer were evaluated as in Example 1. The results are listed in Tables 1 and 2.

COMPARATIVE EXAMPLE 3

A carrier was prepared in a manner identical with that of Example 1 except that without forming a styrene resin layer, a triboelectricity controlling layer was formed directly on the surface of individual cores by using a coating solution prepared by dissolving 70 g fluoroalkyl methacrylate copolymer in 1.4 ±acetone, thereby a developer was prepared in a manner identical with that of Example 1.

Though the obtained developer exhibited a positive-charge endowing property, its durability was insufficient.

The properties of the developer were evaluated in a manner identical with that of Example 1. The results are listed in Tables 1 and 2.

COMPARATIVE EXAMPLE 4

A carrier was prepared in a manner identical with that of Example 1 except that a triboelectricity controlling layer was formed by a coating solution for forming a triboelectricity controlling layer that was prepared by dissolving a material of the following composition into methyl ethyl ketone, thereby a developer was prepare in a manner identical with that of Example 1.

| | |
|---|---|
| N-perfluorooctylsulfonyl/ N-propylmethyl acrylate copolymer | 1 part by weight |
| Methyl acrylate | 3 parts by weight |
| Methyl methacrylate | 10 parts by weight |

Since the obtained carrier failed to exhibit a positive-charge endowing property, an electrostatic latent image was not developed into a positive image. The properties of the developer were evaluated in a manner identical with that of Example 1. The results are listed in Tables 1 and 2.

The terms used in Tables 1 and 2 are defined as follows. 'Dmax' means a maximum image density that is a relative density of a developed image based on the image density of an original image, i.e. 1.3.

'Fog' was denoted by a relative density of a developed image based on the density of an original image, i.e. 0.

No ..... less than 0.01

Slight ..... not less than 0.01 to less than 0.02

Yes ..... not less than 0.02

'Durability' was denoted by a number of duplicates produced until a fog level of a developed image exceeded 0.03 or until a Dmax value decreased to 0.7 or lower. Furthermore, '50,000 duplicates and over' means that neither a fog level nor a Dmax value had reached the above limits even when 50,000 duplicates were prepared.

'Toner flying-around' was evaluated by examining portions, other than the developer transporting path in the copier, for contamination with a developer after a continuous operation, whereby contamination was regarded as the evidence of toner flying-around.

'Density difference in between leading and trailing edges' was evaluated by performing a copying operation, thereby the presence of 'density difference' was confirmed based on an original image density of 1.3, when the difference in relative densities between the leading and trailing edges on a size "A3" copy sheet exceeded 0.20.

TABLE 1

| | Initial charge potential (μc/g) | Initial image $D_{max}$ | Initial image Fog | Final image $D_{max}$ | Final image Fog | Durability | Toner flying-around | Difference in density between leading and trailing edges |
|---|---|---|---|---|---|---|---|---|
| Example 1 | +20 | 1.42 | No | 1.36 | No | 50,000 duplicates and over | No | 0.05 |
| Example 2 | +22 | 1.42 | No | 1.36 | No | 50,000 duplicates and over | No | 0.05 |
| Example 3 | +18 | 1.42 | No | 1.36 | No | 50,000 duplicates and over | No | 0.06 |
| Example 4 | +18 | 1.41 | No | 1.35 | No | 50,000 duplicates and over | No | 0.05 |
| Example 5 | +16 | 1.40 | No | 1.34 | No | 50,000 duplicates and over | No | 0.05 |
| Example 6 | +12 | 1.43 | No | 1.35 | No | 50,000 duplicates and over | No | 0.04 |
| Example 7 | +17 | 1.40 | No | 1.35 | No | 50,000 duplicates and over | No | 0.05 |
| Example 8 | +15 | 1.40 | No | 1.33 | No | 50,000 duplicates and over | No | 0.06 |
| Comparative 1 | +8 | 1.40 | Slight | 1.40 | Yes | 5,000 duplicates | Yes | 0.25 |
| Comparative 2 | +9 | 1.40 | Slight | 1.40 | Yes | 4,500 duplicates | Yes | 0.22 |
| Comparative 3 | +18 | 1.40 | No | 1.20 | Yes | 31,500 duplicates | Yes | 0.20 |
| Comparative 4 | +18 | 1.35 | No | 1.10 | Yes | 37,000 duplicates | Yes | 0.22 |
| | | | | | | — | — | — |

TABLE 2

| | Initial charge potential (μc/g) | Initial image $D_{max}$ | Initial image Fog | Final image $D_{max}$ | Final image Fog | Durability | Toner flying-around | Difference in density between leading and trailing edges |
|---|---|---|---|---|---|---|---|---|
| Example 1 | +20 | 1.40 | No | 1.35 | No | 50,000 duplicates and over | No | 0.07 |
| Example 2 | +20 | 1.40 | No | 1.35 | No | 50,000 duplicates and over | No | 0.08 |
| Example 3 | +17 | 1.42 | No | 1.33 | No | 50,000 duplicates and over | No | 0.08 |
| Example 4 | +16 | 1.42 | No | 1.32 | No | 50,000 duplicates and over | No | 0.09 |
| Example 5 | +15 | 1.42 | No | 1.34 | No | 50,000 duplicates and over | No | 0.10 |
| Example 6 | +10 | 1.42 | No | 1.31 | No | 50,000 duplicates and over | No | 0.08 |
| Example 7 | +15 | 1.43 | No | 1.32 | No | 50,000 duplicates and over | No | 0.09 |
| Example 8 | +13 | 1.41 | No | 1.34 | No | 50,000 duplicates and over | No | 0.07 |
| Comparative 1 | +6 | 1.4 | Slight | 1.30 | Yes | 4,000 duplicates | Yes | 0.31 |
| Comparative 2 | +6 | 1.4 | Slight | 1.30 | Yes | 3,700 duplicates | Yes | 0.30 |
| Comparative 3 | +15 | 1.4 | No | 1.20 | Yes | 20,000 duplicates | Yes | 0.29 |
| Comparative 4 | +15 | 1.3 | No | 1.05 | Yes | 22,000 duplicates | Yes | 0.30 |
| | | | | | | — | — | — |

EXAMPLE 9

Preparation of Carrier

Into 400 ml mixture solvent of toluene and methanol (volume ratio =9 : 1) was dissolved 20 g methyl methacrylate/styrene copolymer (copolymer molar ratio=4:6, Mw=134000, Mw/Mn =1.9) to prepare a coating solution for forming an intermediate layer.

The coating solution was applied onto 2 kg ferrite core particles (F-150, manufactured by Nippon Teppun Co., Ltd.; average particle size, 80 μm) using a tumbled fluidized bed coater (Okada Seiko Co., Ltd.; spiller coating system) to form an intermediate layer on the surface of individual core particles.

Then, 40 g of a fluoroalkyl methacrylate copolymer, comprising the repeating structural units represented by the following formulas [I], was dissolved in 800 m±toluene to prepare a coating solution for forming a triboelectricity controlling layer.

$$\left(CH_2-\underset{\underset{O=COCH_2CF_3}{|}}{C}(CH_3)\right) \quad (1)$$

[η] 0.49 dl/g (MEK, 35° C.)

With the so-obtained coating solution, a triboelectricity controlling layer was formed on the above-mentioned intermediate layer of individual carrier particles by using a fluidized-bed/tumbling coating machine, thus a positive-charge endowing carrier was prepared.

Preparation of Toner Particles 332 g phthalic acid, 90 g of polyoxypropylene (2,2)-bis(4--hydroxyphenyl)propane, and 587 g bisphenol A were poured into a round bottom flask that was provided with a thermometer, stainless steel stirrer, glass tube nitrogen gas inlet as well as a flow-down condenser. The flask was placed on a mantle heater, thereby the materials in the flask was heated while the inside thereof being kept chemically inert with nitrogen gas introduced via the nitrogen gas inlet.

Next, after adding 0.05 g dibutyltin oxide, and while the softening point of the mixture was monitored, the materials mixed were allowed to react at 200° C., thereby a polyester resin was obtained.

100 parts by weight the so-obtained polyester resin, 10 parts by weight Carbon Black (Regal 660R manufactured by Cabot Co., Ltd.) and 3 parts by weight low-molecular polypropylene (Viscol 660P manufactured by Sanyo Chemical Industry Co., Ltd.), and 2 parts by weight ethylenebisstearoylamide (Hoechst Wax C, manufactured by Hoechst) were mixed by means of a ball mill and further treated in the processes involving kneading, pulverization and classification. Then, to the resultant particles were added 0.4 wt% fine hydrophobic silica particles "Aerosil R-812" and 0.2 parts by weight zinc stearate to prepare a positive-charge type toner.

The average particle size of the so-obtained toner was 10 μm.

Preparation of Developers for Developing Electrostatic Latent Image

A carrier, and toner particles were blended together to prepare each of the developers of the invention whose contents of the toner particles were respectively 4wt%.

EXAMPLE 10

A carrier was prepared in a manner identical with that of Example 9 except that a fluoroalkyl methacrylate polymer composed of the repeating structural units represented by the following formula (2), instead of the fluoroalkyl methacrylate polymer in Example 9 composed of the repeating structural units represented by formula (1) was used, thereby a developer for developing an electrostatic latent image was prepared in a manner identical with that of Example 9.

$$\left(CH_2-\underset{\substack{|\\ O=COCH_2CF_2CF_3}}{C}(CH_3)\right) \quad (2)$$

[η] 0.50 dl/g (MEK, 35° C.)

EXAMPLE 11

A carrier was prepared in a manner identical with that of Example 9 except that a fluoroalkyl methacrylate polymer composed of the repeating structural units represented by the following formula (3), instead of the fluoroalkyl methacrylate polymer in Example 9 composed of the repeating structural units represented by formula (1) was used, thereby a developer for developing an electrostatic latent image was prepared in a manner identical with that of Example 9.

$$\left(CH_2-\underset{\substack{|\\ O=COCH_2CF_2CF_2H}}{C}(CH_3)\right) \quad (3)$$

EXAMPLE 12

A carrier was prepared in a manner identical with that of Example 9 except that a fluoroalkyl methacrylate polymer composed of the repeating structural units represented by the following formula (4), instead of the fluoroalkyl methacrylate polymer in Example 9 composed of the repeating structural units represented by formula (1) was used, thereby a developer for developing an electrostatic latent image was prepared in a manner identical with that of Example 9.

$$\left(CH_2-\underset{\substack{|\\ O=COCH_2CF_2CF_3}}{C}(CH_3)\right)_{80}\left(CH_2-\underset{\substack{|\\ O=COCH_3}}{C}(CH_3)\right)_{20} \quad (4)$$

[η] 0.49 dl/g (MEK, 35° C.)

EXAMPLE 13

A carrier was prepared in a manner identical with that of Example 9 except that a fluoroalkyl methacrylate polymer composed of the repeating structural units represented by the following formula (5), instead of the fluoroalkyl methacrylate polymer in Example 9 composed of the repeating structural units represented by formula (1) was used, thereby a developer for developing an electrostatic latent image was prepared in a manner identical with that of Example 9.

$$\left(CH_2-\underset{\substack{|\\ O=COCH_2CF_2CF_3}}{C}(CH_3)\right)_{55}\left(CH_2-\underset{\substack{|\\ O=COCH_3}}{C}(CH_3)\right)_{45} \quad (5)$$

[η] 0.60 dl/g (MEK, 35° C.)

EXAMPLE 14

A developer for developing an electrostatic latent image was prepared in a manner identical with that of Example 10 except that instead of toner particles in Example 10, the toner particles used were prepared with a polyester resin prepared in accordance with the following process.

Preparation of Polyester Resin

A polyester resin was prepared in a manner identical with the polyester preparation process for preparing toner particles of Example 9 except that 180 g 1,4-butanediol was used as a diol component, and that 45 g isophthalic acid was used as a dicarboxylic acid component.

EXAMPLE 15

A developer for developing an electrostatic latent image was prepared in a manner identical with that of Example 12 except that the toner particles used identical with those of Example 6.

Comparative EXAMPLE 6

A carrier was prepared in a manner identical with that of Example 9 except that a coating solution used was a coating solution for forming a triboelectricity controlling layer prepared by dissolving both 12 g fluoroalkyl methacrylate used in Example 9 and 28 g polymethacrylate in 800 ml acetone/toluene mixture solvent (mixture ratio by volume =9:1), thereby a developer for developing an electrostatic latent image was prepared in a manner identical with that of Example 9.

Comparative EXAMPLE 7

A fluoroalkyl methacrylate copolymer composed of repeating structural units defined below ([η] 0.60 dl/g, MEK, 35° C.) was used instead of the fluoroalkyl methacrylate copolymer used in Example 9. Other than this arrangement, a carrier was prepared in a manner identical with that of Example 9, and then a developer for developing an electrostatic latent image was prepared in a manner identical with that of Example 9.

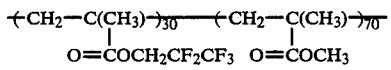

Comparative EXAMPLE 8

A carrier was prepared in a manner identical with that of Example 9 except that without forming a styrene resin layer, a triboelectricity controlling layer was formed directly on the surface of individual cores by using a coating solution prepared by dissolving 70 g fluoroalkyl methacrylate copolymer in 1.4 1 acetone, thereby a developer for developing an electrostatic latent image was prepared in a manner identical with that of Example 9.

Comparative EXAMPLE 9

A carrier was prepared in a manner identical with that of Example 9 except that a triboelectricity controlling layer was formed by a coating solution for forming a triboelectricity controlling layer that was prepared by dissolving a material of the following composition into methyl ethyl ketone, thereby a developer for developing an electrostatic latent image was prepare in a manner identical with that of Example 9.

| | |
|---|---|
| N-perfluorooctylsulfonyl/ N-propylmethyl acrylate copolymer | 1 part by weight |
| Methyl acrylate | 3 parts by weight |
| Methyl methacrylate | 10 parts by weight |

EVALUATION

Continuous copying operation was performed with each of the obtained developers, by employing a modified electrophotographic copier (U-Bix Model 1550 manufactured by Konica Corporation), which incorporated a negative charge type organic dual-layer photoreceptor containing an anthoanthrone dye as a carrier generating material as well as a carbazole derivative as a carrier transporting material.

With regards to each of the developers, Table 3 lists the data of the initial charge potential, initial image, final image, and ability to continuously provide 70,000 duplicates (durability).

Further, continuous copying operation was performed by using the above copier under the conditions of a temperature of 30° C. and a humidity of 80%.

With regards to each of the developers for developing an electrostatic latent image, Table 4 lists the data of the initial charge potential, initial image, final image, and a number of duplicates produced by the continuous copying operation.

The terms used in Tables 3 and 4 are defined as follows.

'Dmax' means a maximum image density that is a relative density of a developed image based on the image density of an original image, i.e. 1.3.

'Fog' was denoted by a relative density of a developed image based on the density of an original image, i.e. 0. The criteria for the fog in Tables 3 and 4 are as follows.

No ..... less than 0.01
Slight ..... not less than 0.01 to less than 0.02
Yes ..... not less than 0.02

'Durability' was denoted by a number of duplicates produced until a fog level of a developed image exceeded 0.03 or until a Dmax value decreased to 0.7 or lower. Furthermore, '70,000 duplicates and over' means that neither a fog level nor a Dmax value had reached the above limits even when 70,000 duplicates were prepared.

TABLE 3

| | Initial charge potential | Initial image | | Final image | | |
|---|---|---|---|---|---|---|
| | (μc/g) | $D_{max}$ | Fog | $D_{max}$ | Fog | Durability |
| Example 9 | +22 | 1.43 | No | 1.38 | No | 70,000 duplicates and over |
| Example 10 | +20 | 1.42 | No | 1.39 | No | 70,000 duplicates and over |
| Example 11 | +24 | 1.41 | No | 1.35 | No | 70,000 duplicates and over |
| Example 12 | +18 | 1.42 | No | 1.35 | No | 70,000 duplicates and over |
| Example 13 | +15 | 1.44 | No | 1.37 | No | 70,000 duplicates and over |
| Example 14 | +21 | 1.42 | No | 1.38 | No | 70,000 duplicates and over |
| Example 15 | +16 | 1.42 | No | 1.36 | No | 70,000 duplicates and over |
| Comparative 6 | +20 | 1.38 | Slight | 0.80 | Yes | 50,000 duplicates and over |
| Comparative 7 | +9 | 1.42 | Slight | 1.30 | Yes | 14,000 duplicates and over |
| Comparative 8 | +20 | 1.42 | No | 1.25 | Yes | 31,500 duplicates and over |
| Comparative 9 | −6 | Image not formed | | Image not formed | | — |

TABLE 4

| | Initial charge potential | Initial image | | Final image | | |
|---|---|---|---|---|---|---|
| | (μc/g) | $D_{max}$ | Fog | $D_{max}$ | Fog | Durability |
| Example 9 | +20 | 1.41 | No | 1.35 | No | 70,000 duplicates and over |
| Example 10 | +19 | 1.40 | No | 1.35 | No | 70,000 duplicates and over |
| Example 11 | +22 | 1.41 | No | 1.35 | No | 70,000 duplicates and over |
| Example 12 | +17 | 1.41 | No | 1.34 | No | 70,000 duplicates and over |
| Example 13 | +14 | 1.41 | No | 1.35 | No | 70,000 duplicates and over |
| Example 14 | +19 | 1.40 | No | 1.34 | No | 70,000 duplicates and over |
| Example 15 | +15 | 1.42 | No | 1.33 | No | 70,000 duplicates and over |
| Comparative 6 | +18 | 1.38 | Slight | 0.70 | Yes | 31,500 duplicates and over |
| Comparative 7 | +7 | 1.40 | Slight | 1.30 | Yes | 9,000 duplicates and over |
| Comparative 8 | +17 | 1.40 | No | 1.10 | Yes | 23,000 duplicates and over |

TABLE 4-continued

| | Initial charge potential | Initial image | | Final image | | |
|---|---|---|---|---|---|---|
| | (μc/g) | $D_{max}$ | Fog | $D_{max}$ | Fog | Durability |
| Comparative 9 | −4 | Image not formed | | Image not formed | | — |

As can be understood from the results in Tables 3 and 4, since the resultant initial charge potentials are within a preferable range, the developers of the invention for developing an electrostatic latent image are capable of forming extremely vivid initial images The loss in image quality is limited with the repeatedly used developers of the invention, whereby these developers of the invention continuously provided 70,000 duplicates and more.

In contrast, the developer for forming an electrostatic latent image, and that was prepared in Comparative Example 6, exhibited significant loss in the charge potential in the course of usage, thereby the Dmax of the final image was low. With the developer for developing an electrostatic latent image, and that was prepared in Comparative Example 7, the increase in the charge potential at the initial stage of operation was poor, thereby the initial charge potential level was insufficient. With the developer for developing an electrostatic latent image, and that was prepared in Comparative Example 7, the durability of the carrier was insufficient, thereby the characteristics of the developer changed in the course of copying operation. Accordingly, these developers for forming an electrostatic latent image commonly failed to provide 70,000 duplicates.

Additionally, the developer for developing an electrostatic latent image, and that was prepared in Comparative example 9, failed to develop an electrostatic latent image, since its triboelectricity was irrelevant to an electrostatic latent image.

What is claimed is:

1. A carrier for use in a developer for electrophotography, which comprises:

(a) a core material and provided thereon in order, (b) an intermediate resin layer, (c) a layer for controlling triboelectric chargeability containing a polymer which contains as a repeating unit a fluorinated alkyl acrylate or fluorinated alkyl methacrylate unit in a proportion by weight not less than 55%, (d) wherein the content of said polymer in said layer for controlling triboelectric chargeability is not less than 70 weight %, and (e) wherein the thickness of said intermediate layer is 0.1 to 2.0 μm.

2. The carrier of claim 1, wherein said intermediate resin layer contains a resin selected from the group consisting of styrene resins, acrylate resins, polyolefin resins, polyurethane resins, nitrogen-containing vinyl resins, polyester resins, polyamide resins, polycarbonate resins, cellulose derivatives and silicone resins.

3. The carrier of claim 2, wherein said resin contained in the intermediate resin layer is a styrene resin containing a styrene monomer unit.

4. The carrier of claim 3, wherein said styrene monomer unit is selected from the group consisting of a styrene, an alkylstyrene, a halogenated styrene, a nitro styrene, an acetyl styrene.

5. The carrier of claim 3, wherein said styrene resin is a homopolymer or a copolymer.

6. The carrier of claim 5, wherein said copolymer contains as a monomer unit a styrene type monomer and an alkyl-methacrylate monomer

7. The carrier of claim 6, wherein said copolymer is a styrene-alkylmethacrylate copolymer.

8. The carrier of claim 7, wherein said copolymer is a styrene-methylmethacrylate copolymer.

9. The carrier of claim 1, wherein the amount of resin used in the intermediate layer is not less than 0.5 by weight relative to that of the core material.

10. The carrier of claim 1, wherein said repeating unit is represented by general formula [I];

$$\begin{array}{c} +CH_2-CR^1+ \\ | \\ O=C-R^2 \end{array} \qquad [I]$$

wherein R′ is a hydrogen atom or a methyl group, R′ is a residue of an alcoholic compound of which hydrogen atom of the hydroxyl group has been split off and of which at least one hydrogen atom of the alkyl group has been substituted by a fluorine atom.

11. The carrier of claim 10, wherein said repeating unit is represented by genera formula (a) or (b);

$$\begin{array}{c} +CH_2-CR^1+ \\ | \\ O=CO(CH_2)_nC_mF_{2m+1} \end{array} \qquad (a)$$

$$\begin{array}{c} +CH_2-CR^1+ \\ | \\ O=CO(CH_2)_p(CF_2)_qH \end{array} \qquad (b)$$

wherein R′ is a hydrogen atom or a methyl group, n and p independently represent integers of 1 to 8, and m and q independently represent integers of 1 to 19.

12. The carrier of claim 1, wherein said core material is selected from the group consisting of an inorganic powder, a metal powder, a metal oxide powder and an organic metal powder.

13. The carrier of claim 10, wherein said core material is selected from the group consisting of an inorganic powder, a metal powder, a metal oxide powder and an organic metal powder.

14. A developer for electrophotography which comprises:

(a) a carrier comprising a core material and provided thereon in order, an intermediate resin layer and a layer controlling triboelectric chargeability containing a polymer which contains as a repeating unit a fluorinated alkyl-methacrylate unit in a proportion by weight not less than 55%, and (b) wherein the content of said polymer in said layer for controlling triboelectric chargeability is not less than 70 weight %, (c) wherein the thickness of said intermediate layer is 0.1 to 2.0 m, and (d) a positively chargeable toner.

15. The developer of claim 14, wherein said toner contains a polyester resin.

* * * * *

UNITED STATES PATENT AND TRADEMARK OFFICE

CERTIFICATE OF CORRECTION

PATENT NO. : 4,965,159

DATED : October 23, 1990

INVENTOR(S) : Shigenori Kohno et al.

It is certified that error appears in the above-identified patent and that said Letters Patent is hereby corrected as shown below:

Title Page:

In the Abstract, Lines 5-6, "alkylmethakrylak" should be --alkylmethacrylate--.

Claim 6, Column 22, Line 10, "styrene hype" should be --shyrene--.

Claim 10, Column 22, Line 25, "R" (first occurrence) should be --$R^1$--; and "R" (second occurrence) should be --$R^2$--.

Claim 11, Column 22, Line 31, "genera" should be --general--;

UNITED STATES PATENT AND TRADEMARK OFFICE

CERTIFICATE OF CORRECTION

PATENT NO. : 4,965,159

DATED : October 23, 1990

INVENTOR(S) : Shigenori Kohno, et al

It is certified that error appears in the above-identified patent and that said Letters Patent is hereby corrected as shown below:

Claim 11, Column 22, Line 41, "R" should be --$R^1$--.

Signed and Sealed this

Twenty-second Day of September, 1992

*Attest:*

DOUGLAS B. COMER

*Attesting Officer*

*Acting Commissioner of Patents and Trademarks*

UNITED STATES PATENT AND TRADEMARK OFFICE

CERTIFICATE OF CORRECTION

PATENT NO. : 4,965,159

DATED : October 23, 1990

INVENTOR(S) : Shigenori Kohno et al.

It is certified that error appears in the above-identified patent and that said Letters Patent is hereby corrected as shown below:

Abstract, lines 5-6, change "alkylmethakrylarte" to --alkylmethacrylate--.

Claim 6, column 22, line 10, change "styrene type" to --styrene--.

Claim 10, column 22, line 25, change "R′" (first occurence) to --$R^1$--; and "R′" (second occurence) to --$R^2$--.

Claim 11, column 22, line 31, change "genera" to --general--.

Claim 11, column 22, line 41, change "R′" to --$R^1$--.

This certificate supersedes Certificate of Correction issued September 22 1992.

Signed and Sealed this

Tenth Day of September, 1996

*Attest:*

Bruce Lehman

BRUCE LEHMAN

*Attesting Officer*

*Commissioner of Patents and Trademarks*